US012123283B2

(12) United States Patent
Simpson

(10) Patent No.: US 12,123,283 B2
(45) Date of Patent: Oct. 22, 2024

(54) SELECTIVE CONNECTION OF DOWNHOLE REGIONS

(71) Applicant: Baker Hughes Oilfield Operations LLC, Houston, TX (US)

(72) Inventor: Graeme David Simpson, Aberdeen (GB)

(73) Assignee: Baker Hughes Oilfield Operations LLC, Houston, TX (US)

( * ) Notice: Subject to any disclaimer, the term of this patent is extended or adjusted under 35 U.S.C. 154(b) by 158 days.

(21) Appl. No.: 17/755,303

(22) PCT Filed: Oct. 27, 2020

(86) PCT No.: PCT/US2020/057474
§ 371 (c)(1),
(2) Date: Apr. 26, 2022

(87) PCT Pub. No.: WO2021/086825
PCT Pub. Date: May 6, 2021

(65) Prior Publication Data

US 2022/0381115 A1 Dec. 1, 2022

(30) Foreign Application Priority Data

Oct. 30, 2019 (GB) ..... 1915764

(51) Int. Cl.
*E21B 34/08* (2006.01)
*E21B 34/12* (2006.01)
(Continued)

(52) U.S. Cl.
CPC ..... *E21B 34/08* (2013.01); *E21B 34/12* (2013.01); *E21B 43/128* (2013.01); *E21B 43/14* (2013.01); *E21B 2200/06* (2020.05)

(58) Field of Classification Search
CPC ..... E21B 34/08; E21B 2200/06
See application file for complete search history.

(56) References Cited

U.S. PATENT DOCUMENTS 6,289,990 B1 * 9/2001 Dillon ..... F16K 17/19 166/373
10,760,377 B1 * 9/2020 Hegarty ..... E21B 34/102
(Continued)

FOREIGN PATENT DOCUMENTS

| | | | |
|---|---|---|---|
| GB | 2411416 | A | 8/2005 |
| WO | 2014-004144 | A2 | 1/2014 |
| WO | 2016-114869 | A1 | 7/2016 |

OTHER PUBLICATIONS

ISA/KR; Search Report; PCT/US2020/057474; Mailed Jan. 29, 2021.

(Continued)

*Primary Examiner* — Blake Michener
(74) *Attorney, Agent, or Firm* — Crowe & Dunlevy. P.C.

(57) ABSTRACT

A method and apparatus for selectively connecting a first fluid communication region to a further fluid communication region are disclosed. The apparatus comprises an elongate housing, locatable in a wellbore, comprising a first end portion associated with a first fluid communication region; a sheath member axially slidable within the housing and biased towards the first end portion via at least one biasing element; and an elongate shuttle member axially slidable within the housing and slidably locatable in a sealed relationship or non-sealed relationship with the sheath member; wherein the biasing element provides a predetermined biasing force that determines a threshold pressure which must be exceeded by a fluid pressure in the first fluid communication region to permit axial movement of the sheath member away from the first fluid communication region or towards a further fluid communication region.

16 Claims, 8 Drawing Sheets

(51) Int. Cl.
*E21B 43/12* (2006.01)
*E21B 43/14* (2006.01)

(56) References Cited

U.S. PATENT DOCUMENTS

| | | | | |
|---|---|---|---|---|
| 2007/0000665 | A1 | 1/2007 | Tudor et al. | |
| 2009/0056934 | A1* | 3/2009 | Xu | E21B 43/26 166/194 |
| 2010/0282476 | A1 | 11/2010 | Tessier et al. | |
| 2012/0312540 | A1* | 12/2012 | Lefebvre | E21B 34/10 166/319 |
| 2015/0027706 | A1* | 1/2015 | Symms | E21B 34/066 166/185 |
| 2015/0041148 | A1 | 2/2015 | Greenan | |
| 2016/0312579 | A1 | 10/2016 | Green et al. | |
| 2018/0328143 | A1 | 11/2018 | Osborne | |
| 2019/0128100 | A1 | 5/2019 | Andersson | |

OTHER PUBLICATIONS

ISA/KR; Written Opinion of the Int'l Searching Authority; PCT/US2020/057474; Mailed Jan. 29, 2021.
WIPO (IB); Int'l Preliminary Written Report on Patentability; PCT/US2020/057474; Mailed May 3, 2022.

* cited by examiner

SECTION A-A

SELECTIVE CONNECTION OF DOWNHOLE REGIONS

The present invention relates to a method and apparatus for selectively connecting a first fluid communication region to a further fluid communication region at a downhole location. In particular, but not exclusively, the present invention relates to a tubing drain valve comprising at least one biasing element that determines a threshold pressure that must be overcome by a fluid pressure at the first fluid communication region to connect the first fluid communication region to a further fluid communication region.

The necessity of extracting a fluid from a subterranean location is well known. In particular the extraction of water, oil and other fluids through a borehole is widely utilised. Boreholes are generally drilled into the ground in order to access subterranean fluid deposits. Depths of boreholes may therefore vary from a few metres to tens of thousands of meters depending on the depth of the fluid deposit. Wellbore systems often include a borehole drilled for the purpose of fluid extraction. These can include one or more downhole tubing arrangements extending into the borehole. Often more than one downhole tubing arrangement is utilised. Conventionally the outer circumference of the borehole is lined with securing material, often concrete, including perforations which allow fluid to ingress into the borehole from fluid deposits at least partially surrounding a portion of the borehole. The space between the tubing arrangement and the borehole lining provides an annulus which can permit fluid flow within the bore. A tubing bore defined by and within the tubing arrangement also provides a passageway for fluid flow and is often the fluid passageway through which fluid is extracted from downhole regions of the borehole. This is particularly useful in a wellbore system that requires artificial lift. The wellbore is often capped by further production apparatus which, particularly in oil and gas production applications, is a wellhead apparatus. In subsea wellbore systems, the wellhead apparatus is often a subsea tree.

Wellbore systems may contain substantial internal pressure such that a desired fluid is ejected from the subterranean location and through the borehole or tubing bore naturally. Often though it is necessary to artificially provide lift to the wellbore system to extract the fluid from downhole regions of the borehole. In fact, most wellbore systems will require a degree of artificial lift at some point in their production lifetimes. Many methods of providing artificial lift are known in the art and the utilisation of a particular method largely depends on its suitability for a particular wellbore system, particularly considering the environment of the wellbore system, and the degree of lift required. One such method with particular relevance to both on land and subsea wellbore applications involves the use of one or more Electric Submersible Pumps (ESPs).

An ESP is a downhole device used to artificially generate lift at a subterranean location and is used particularly in oil and water production applications. ESPs are generally positioned in a borehole as part of/within the downhole tubing arrangement. ESPs are often centrifugal pumps (which may be multistage centrifugal pumps) and therefore include an impeller (or a series of impellers) which rotates to move fluid up the tubing arrangement. An ESP is generally located in a section of the tubing arrangement directly above one or more inlet ports and towards the downhole-most end of a particular tubing arrangement. The rotating impeller of the ESP thereby imparts a pressure differential across the tubing section such that fluid is drawn into the tubing arrangement from the annulus via the inlet port and fluid in the tubing arrangement is moved towards the surface of the borehole. As fluid is drawn into the tubing further fluid from the fluid deposits may ingress into the annulus via the borehole perforations.

There may be instances which require the ESP to be switched off. Examples of such occasions include instances wherein artificial lift is not required (either due to the natural pressure of the wellbore system being sufficient for fluid extraction through the borehole/tubing arrangement or during a lapse in fluid production of the wellbore system) and instances wherein maintenance of the ESP or other apparatus (downhole or otherwise) is required. Conventionally reduced lift due to switching off the ESP can result in fluid inside the tubing arrangement falling towards a downhole tubing end under gravity or other such mechanisms. Fluid in the tubing arrangement above the ESP can therefore fall through the ESP in the absence of lift thereby forcing the impeller to rotate in a direction opposed to its intended direction of operation. This forced rotation may cause damage to the ESP which can be costly and time consuming to repair and can render the whole wellbore system inactive for a period of time thereby incurring further substantial costs and profit loss. Subterranean fluids such as oil can also carry a wide variety of debris such as rock particulates and sand and the like, particularly in a wellbore system wherein a borehole has been drilled. This debris can enter the ESP causing significant damage and can form plugs/blockages in the tubing arrangement above the ESP thereby reducing function of the wellbore system or rendering it inactive.

Tubing drain valve apparatus are known in the art. Generally tubing drain valves are located in a portion of the downhole tubing arrangement between a first fluid communication region at a substantially downhole location and within the tubing arrangement and a further fluid communication region within the tubing arrangement at a downhole location that is further towards the surface relative to the first fluid communication. Tubing drain valves are intended to operate to inhibit fluid communication between the first and further fluid communication regions (thereby inhibiting fluid trapped above the ESP in the tubing falling through the ESP) while provide a lateral port/draining passageway into the annulus (thereby allowing fluid trapped inside the tubing proximate to the further fluid communication region to drain into the annulus). Tubing drain valves are also intended to operate to connect the first fluid communication region and the further fluid communication region when lift is provided by the ESP while closing the lateral port/draining passageway to the annulus thereby allowing fluid extraction through the tubing arrangement.

Conventional tubing drain valves are limited to use in particular wellbore systems. In particular, it is desirable in some wellbore systems to allow fluid to flow into the tubing arrangement from the annulus via the lateral port/draining passageway. Some examples of these wellbore systems are free flowing wells and dual-completion systems. Dual-completion systems are wellbore systems in which fluid can be extracted from two fluid deposits simultaneously and often contain more than one tubing arrangement. Dual-completion systems have become a relatively common wellbore system in recent years. However, it has been found that some conventional tubing drain valves are not suitable for use in some free flowing or dual-completion or similar wellbore systems. In particular, it has been found that a fluid pressure in the annulus can result in the closing of the lateral port/draining passageway and connecting the first and further fluid communication regions thereby forcing fluid through the ESP. In some conventional systems this annular fluid pressure has been found to be around 3-7 psi however it will be understood that this pressure may vary significantly between systems. This results in reduced production and an inability to implement such tubing drain valves in some free flowing or dual-completion or similar wellbore systems.

It is an aim of the present invention to at least partly mitigate one or more of the above-mentioned problems.

It is an aim of certain embodiments of the present invention to selectively connect a first fluid communication region in a tubing bore to a further fluid communication region in a tubing bore.

It is an aim of certain embodiments of the present invention to provide a tubing drain valve suitable for dual-completion wellbore systems and/or wellbore systems with adequate natural lift and/or any wellbore system in which fluid from an annulus flows into the tubing bore in the absence of artificial lift such as when the ESP is shutdown.

It is an aim of certain embodiments of the present invention to provide a tubing drain valve in which at least one biasing element, which optionally is at least one magnet, determines a particular threshold pressure, which optionally is around 200 psi, which must be overcome by a fluid pressure proximate to a first fluid communication region in the tubing bore to connect the first fluid communication region to a further fluid communication region in the tubing bore.

It is an aim of certain embodiments of the present invention to provide a tubing drain valve comprising at least one biasing element, which optionally is at least one magnet, that does not include frictional components or introduce substantial friction to the tubing drain valve.

It is an aim of certain embodiments of the present invention to provide apparatus comprising at least one lateral port being open to an annulus and a biasing element, which optionally is at least one magnet, wherein the biasing element determines a threshold pressure, which optionally is around 200 psi, which must be overcome by a fluid pressure proximate to a first fluid communication region in the tubing bore to close the lateral port to the annulus.

According to a first aspect of the present invention there is provided apparatus for selectively connecting a first fluid communication region to a further fluid communication region at a downhole location, comprising:

an elongate housing, locatable in a wellbore, comprising a first end portion associated with a first fluid communication region;

a sheath member axially slidable within the housing and biased towards the first end portion via at least one biasing element; and an elongate shuttle member axially slidable within the housing and slidably locatable in a sealed relationship or non-sealed relationship with the sheath member; wherein the biasing element provides a predetermined biasing force that determines a threshold pressure which must be exceeded by a fluid pressure at the first fluid communication region to permit axial movement of the sheath member away from the first fluid communication region or towards a further fluid communication region.

Aptly in a first mode of operation, the sheath member is biased towards the first end portion and the shuttle member is disposed in a first position providing a sealed relationship with the sheath member;

in an intermediate mode of operation, the sheath member is axially displaced towards the further fluid communication region relative to said a position of the first mode of operation but remains disposed in a sealed relationship with the sheath member; and in a further mode of operation, the shuttle member is further axially displaced towards the further fluid communication region and is disposed in a non-sealed relationship with the sheath member.

Aptly the housing comprises at least one first lateral port that are each proximate to the further fluid communication region; and the shuttle member comprises at least one further lateral port that is selectively locatable proximate to the further fluid communication region in an aligned relationship with a respective first lateral port; wherein the first lateral port and the further lateral port are at least partially aligned in the first mode of operation, and the first lateral port and the further lateral port are axially non-aligned in the intermediate and further modes of operation.

Aptly the apparatus further comprises a sleeve member axially slidable within the housing and disposed between the housing and the shuttle member, wherein the sleeve member is disposed to at least partially leave open the first lateral port in the first mode of operation, and the sleeve member is disposed to close the first lateral port in the intermediate and further mode of operation.

Aptly the biasing element comprises at least one magnetic element and optionally the housing comprises a seat in which the magnetic element is disposed; wherein the seat provides an abutment surface against which the sheath member abuts in the first mode of operation to thereby set one extent of axial movement of the sheath member.

Aptly the biasing element is at least partially covered by protective cladding.

Aptly said a fluid pressure is determined by operation of an Electric Submersible Pump (ESP) locatable at or proximate to the first fluid communication region.

Aptly the apparatus further comprises at least one further biasing element to bias the sheath member, the shuttle member and optionally the sleeve member towards the first fluid communication region, and wherein optionally the further biasing element is a spring.

Aptly the apparatus further comprises at least one catch element on an inner surface of the housing disposed to prevent the sheath member, and optionally the sleeve member, from axially moving towards the further fluid communication region, or optionally towards the first fluid communication region, beyond a predetermined distance.

Aptly the housing, sheath member and shuttle member are installed in multi-pump or dual completion system within a wellbore.

According to a second aspect of the present invention there is provided a method of selectively connecting a first fluid communication region to a further fluid communication region at a downhole location, comprising:

providing an elongate housing in a wellbore with a sheath member axially slidable within the housing and an elongate shuttle member axially slidable within the housing, the shuttle member being axially movable to be in a sealed relationship or a non-sealed relationship with the sheath member; and providing a predetermined biasing force on the sheath member via at least one biasing element thereby urging the sheath member towards the first fluid communication region, the biasing force determining a threshold pressure which must be exceeded by a fluid pressure at the first fluid communication region to permit axial movement of the sheath member away from the first fluid communication region or towards a further fluid communication region.

Aptly the method further comprises axially moving the shuttle member and the sheath member together away from the first fluid communication region or towards the further fluid communication region when the fluid pressure exceeds the threshold pressure; and axially moving the shuttle member independently of the sheath member away from the first fluid communication region or towards the further fluid communication region when the sheath member is axially moved to a predetermined distance away from the first fluid communication region or towards a further fluid communication region.

Aptly the method further comprises providing at least one catch element that determines a predetermined distance that the sheath member is axially movable away from the first fluid communication region or towards the further fluid communication region.

Aptly the housing includes at least one first lateral port proximate to the further fluid communication region and the shuttle member includes at least one further lateral port locatable in an at least partially aligned relationship with the first lateral port, the method further comprising:

axially moving the shuttle member away from the first fluid communication region or towards the further fluid communication region such that the first lateral port and the further lateral port are axially non-aligned.

Aptly the housing includes a sleeve member axially slidable within the housing and disposed between the housing and the shuttle member such that the sleeve member is disposed to leave the first lateral port at least partially open, the method further comprising:

axially moving the sleeve member away from the first fluid communication region or towards the further fluid communication region such that the sleeve member is disposed to close the first lateral port.

Aptly the method further comprises providing a biasing element that comprises at least one magnetic element.

Aptly the method further comprises providing at least one further biasing element to bias the sheath member, the shuttle member and optionally the sleeve member towards the first fluid communication region, and wherein optionally the further biasing element is a spring.

Aptly the method further comprises providing an ESP at or proximate to the first fluid communication region which can be operated to determine the fluid pressure.

Aptly the method further comprises providing a dual-completion system within the wellbore.

According to the third aspect of the present invention there is provided a method of selectively connecting a first fluid communication region to a further fluid communication region at a downhole location, comprising:

providing a predetermined biasing force on a sheath member, the sheath member being axially movable within an elongate housing in a wellbore, thereby biasing the sheath member towards a first fluid communication region; and selectively providing a fluid pressure at the first fluid communication region; wherein the biasing force determines a threshold pressure which must be exceeded by the fluid pressure to permit axial movement of the sheath member away from the first fluid communication region or towards a further fluid communication region.

Aptly the method further comprises axially moving an elongate shuttle member within the housing responsive to the fluid pressure, the shuttle member being axially movable to be in a sealed relationship or a non-sealed relationship with the sheath member.

Aptly the method further comprises disposing the shuttle member to be in a sealed relationship with the sheath member when the threshold pressure exceeds the fluid pressure;

axially moving the sheath member together with the shuttle member away from the first fluid communication region or towards the further fluid communication region when the fluid pressure exceeds the threshold pressure;

axially moving the sheath member together with the shuttle member away from the first fluid communication region or towards the further fluid communication region to a predetermined catch point provided by at least one catch element wherein further axial movement of the sheath member in an axial direction away from the first fluid communication region or towards the further fluid communication region is prohibited; and positioning the shuttle member to be in a non-sealed relationship with the sheath member by axially moving the shuttle member, responsive to the fluid pressure, away from the first fluid communication region or towards the further fluid communication region independent of the sheath member.

Aptly the method further comprises at least partially aligning at least one first lateral port in the housing with at least one further lateral port in the shuttle member when the threshold pressure exceeds the fluid pressure thereby permitting fluid communication through the first and further lateral port; and axially non-aligning the first lateral port and the further lateral port when the fluid pressure exceeds the threshold pressure thereby preventing fluid communication through the first and further lateral port.

Aptly the method further comprises axially moving a sleeve member within the housing towards the further fluid communication region to close the first lateral port when the fluid pressure exceeds the threshold pressure thereby closing the first lateral port to an annular fluid communication passage external to the housing.

Aptly the method further comprises biasing the sheath member, the shuttle member and optionally the sleeve member towards the first fluid communication region via at least one further biasing element, wherein optionally the further biasing element is a spring.

Certain embodiments of the present invention provide a tubing drain valve suitable for use in a dual-completion wellbore system and/or wellbore system with substantial natural lift such that artificial lift is not required.

Certain embodiments of the present invention provide ESP protection against the backflow of fluid in a tubing arrangement or from unintentional forced fluid flow through the ESP, particularly when the fluid contains particulate matter, thereby reducing maintenance costs and lost profit due to inactivity of fluid extraction.

Certain embodiments of the present invention provide a tubing drain valve that requires a predetermined threshold pressure to be exceeded by a fluid pressure of a fluid at/proximate to a first fluid communication region to connect the first fluid communication region with a further fluid communication region thereby providing greater control over selective connection of the first and further fluid communication regions.

Certain embodiments of the present invention provide a tubing drain valve wherein pressure fluctuations in the wellbore system, particularly in the annulus and/or tubing arrangement, do not limit fluid flow between the annulus and the tubing bore through the lateral port until a predetermined threshold pressure is exceed by a fluid pressure of a fluid at/proximate to the first fluid communication region.

Certain embodiments of the present invention provide a tubing drain valve including lateral ports, selectively connecting the tubing bore to the annulus, which do not prematurely disconnect the tubing bore from the annulus responsive to variable pressures in the annulus.

Certain embodiments of the present invention will now be described hereinafter, by way of example only, with reference to the accompanying drawings in which.

In the drawings like reference numerals refer to like parts.

Figure 1:
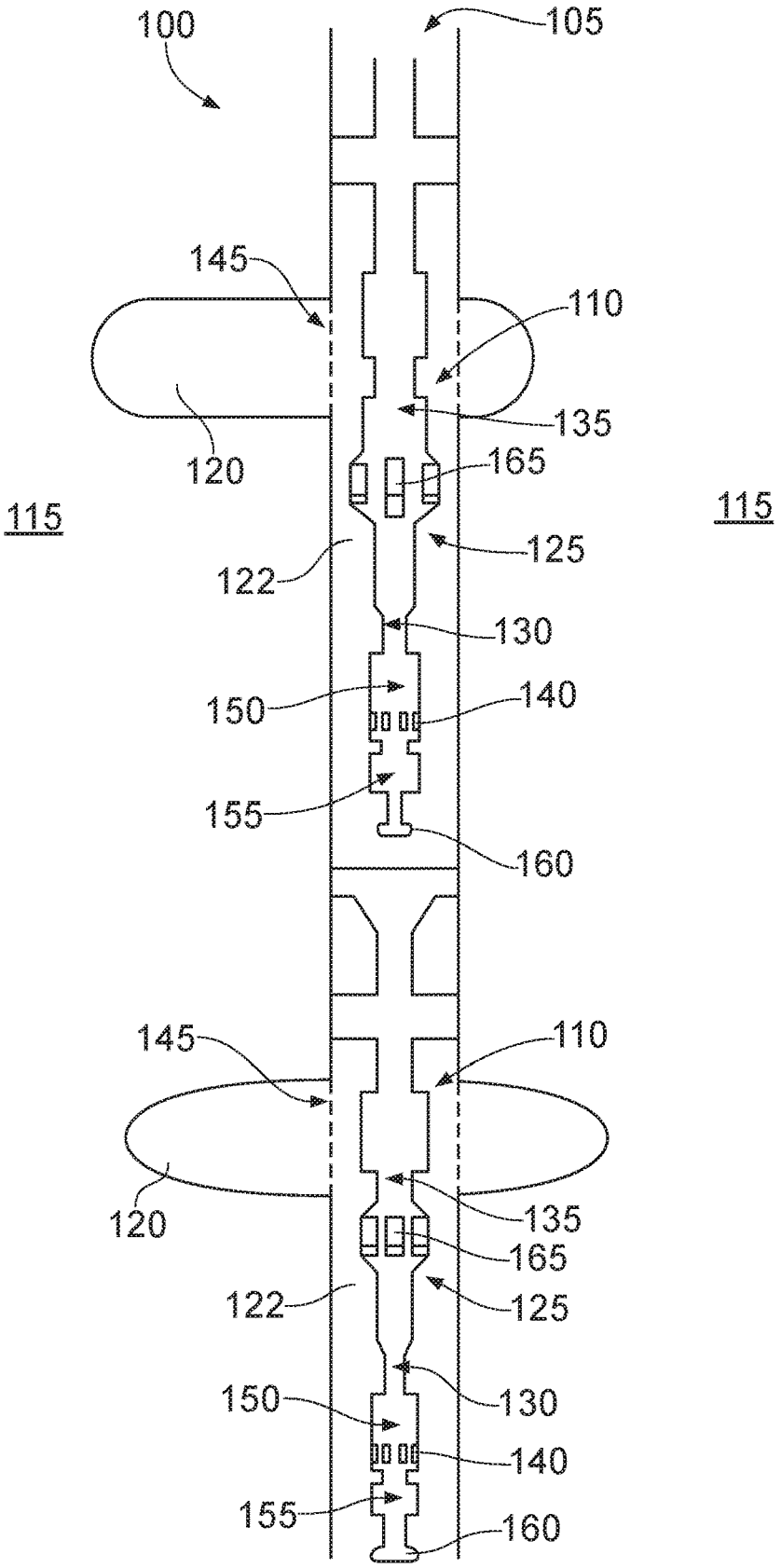
FIG. 1 illustrates a dual completion wellbore system in which artificial lift is provided by two ESPs.

FIG. 1 illustrates how a system for generating artificial lift can be implemented in a wellbore system 100 for aiding in the extraction of oil or other such fluids from a subterranean location through a borehole 105. It will be understood that such a system can be implemented on land or at a subsea location. At least one tubing arrangement 110 is located vertically inside a borehole such that the tubing arrangement extends significantly into the ground 115 and at least to a fluid deposit 120. In the wellbore system illustrated in FIG. 1, two tubing arrangements are located in series in a dual-completion system. The tubing arrangement 110 provides a tubing bore which defines a fluid communication pathway within the tubing arrangement 110. The tubing arrangement 110 also provides an annulus 122 as a space between the tubing arrangement 110 and the inner circumference of the borehole 105 which defines an annular fluid flow passage. A section of the tubing arrangement 110 provides a tubing drain valve 125 which acts to selectively connect a first fluid communication region 130 located within the tubing arrangement at a subterranean location at the fluid deposit 120 to a further fluid communication region 135 located within the tubing arrangement and vertically above the first fluid communication region 130 (closer to the surface of the borehole 105). The tubing arrangement comprises at least one inlet port 140 relatively proximate to the first fluid communication region 130. In the tubing arrangement illustrated a ring of inlet ports 140 extend circumferentially around the body of the tubing arrangement.

Fluid from the fluid deposit 120 can ingress into the borehole 105 through perforations 145 in the borehole circumferential surface. Optionally this fluid is oil. Optionally this fluid is hydrocarbon. Optionally this fluid is water. Optionally this fluid is any other suitable fluid or combination of fluids and particulate matter. It will be understood that the borehole is often lined with a structurally supportive material which intentionally includes the perforations 145. Optionally this material is concrete. Optionally this material is any other suitable material. Optionally the borehole comprises no lining. Fluid in the borehole 105 from the fluid deposit 120 can enter the tubing through the inlet port 140. An Electric Submersible Pump (ESP) 150 is located in the tubing arrangement 110 above the inlet port 140. The ESP 150 includes an impeller which rotates to move the fluid up the tubing arrangement 110 thereby generating lift in the wellbore system 100. As the impeller rotates and moved fluid through the ESP, a local pressure differential is generated across the ESP. This pressure differential results in further fluid being drawn into the tubing arrangement from the borehole 105 via the inlet port 140 to replace fluid moved upwards by the impeller. A motor 155 associated with the ESP 150 is located below the inlet port 140 and optionally a seal is provided between the inlet port 140 and the motor 150. A sensor 160 is optionally located at the downhole terminal end of the tubing arrangement 110.

The tubing drain valve 125 is located between the first fluid communication region 130 and the further fluid communication region 135. The tubing drain valve 125 can selectively connect the first fluid communication region 130 and the further fluid communication region 135 responsive to a fluid pressure at the first fluid communication region 130. The tubing drain valve 125 further comprises at least one lateral port 165 which selectively opens the tubing bore within the tubing drain valve 125 region of the tubing arrangement 110 to the annulus 122. In the tubing arrangement illustrated a ring of lateral ports 165 extend circumferentially around the body of the tubing arrangement. This allows for the draining of fluid within the tubing bore above the tubing drain valve to the annulus 122 in the absence of lift in the wellbore system 100. This also allows for the ingress of fluid from the annulus 122 into the tubing bore when where required. Closing the tubing bore to the annulus 122 via the lateral ports allows for fluid flow from the inlet port 140 to the upper terminus of the tubing arrangement 110 when lift is provided by the ESP 150.

Figure 2A:
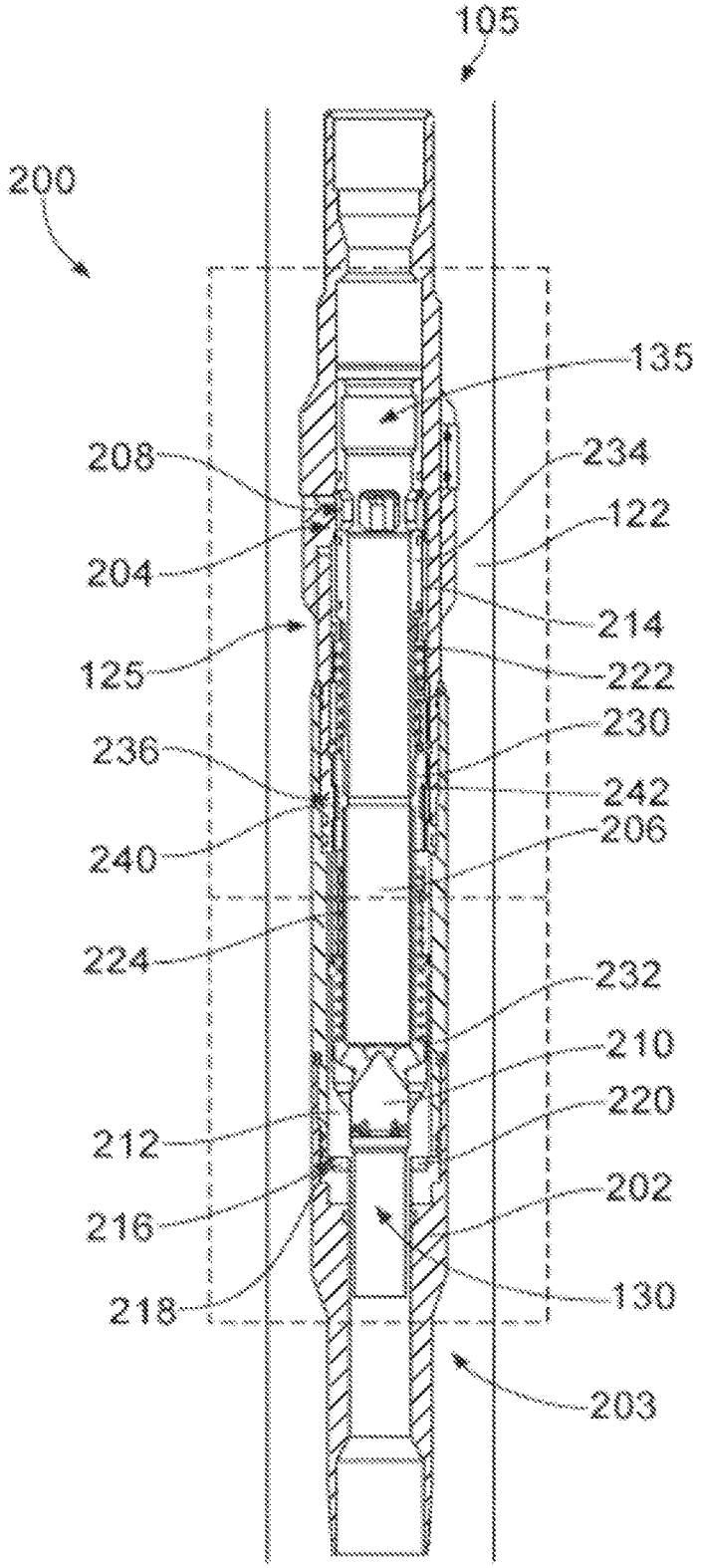
FIG. 2A illustrates a tubing drain valve in a first mode of operation in which a first and further fluid communication region are disconnected.
Figure 2B:
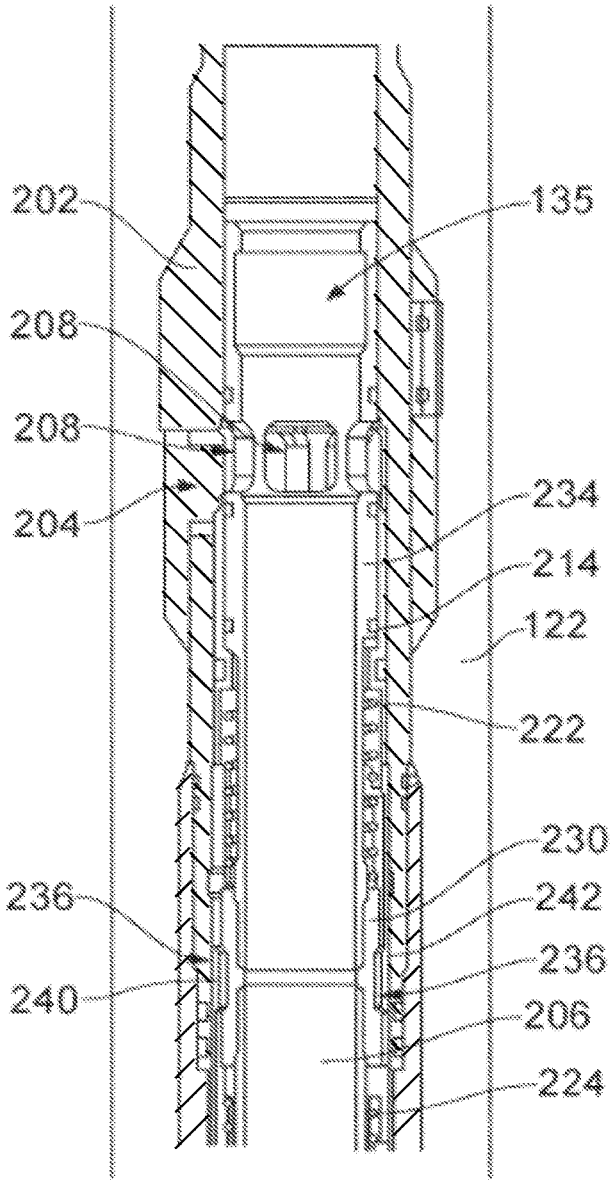
FIG. 2B illustrates an enlargement of the section of FIG. 2A enclosed by the upper dashed-line box.
Figure 2C:
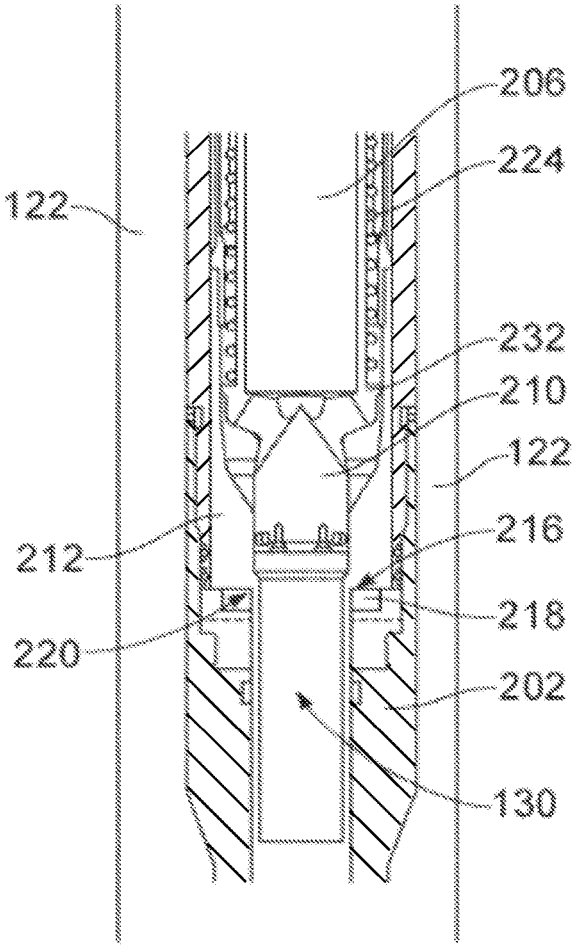
FIG. 2C illustrates an enlargement of the section of FIG. 2A enclosed by the lower dashed-line box.

FIG. 2A illustrates a cross-section of a tubing drain valve in a first mode of operation 200. FIGS. 2B and 2C illustrate enlarged versions of the section of FIG. 2A contained within the upper dashed-line box and the lower dashed-line box respectively. As illustrated in FIG. 1, the tubing drain valve 125 provides a section of the tubing arrangement 110, which provides a fluid communication pathway, between the first fluid communication region 130 and the further fluid communication region 135. The section of tubing enclosing the tubing drain valve 125 provides an elongate housing 202 which comprises a first end portion 203 associated with the first fluid communication region 130. Optionally the housing 202 is made of a rigid material. Optionally this material is steel or some other suitable metal, alloy or composite. Optionally this material is any other suitable material.

Optionally the housing 202 is manufactured as a single part. Optionally the housing 202 comprises multiple parts which are locked/joined together. The housing 202 comprises at least one first lateral port 204 proximate to the further fluid communication region 135, the first lateral port 204 being open to the borehole 105. The housing illustrated comprises a ring of first lateral ports arranged circumferentially. As illustrated in FIG. 1, the space between the tubing arrangement 110 and the circumferential edge of the borehole 105 provides an annulus 122. The annulus 122 is in fluid communication with the first lateral port 204.

Located within the housing 202 is an elongate shuttle member 206 that is movable as an axially slidable member within the housing 202. The shuttle member 206 comprises at least one further lateral port 208 proximate to the further fluid communication region 135 and a plug member 210 at a terminal end of the shuttle member 206 proximate to the first fluid communication region 130. The shuttle member illustrated comprises a ring of first lateral ports arranged circumferentially. A sheath member 212 located within the housing 202 and is movable as an axially slidable member within the housing 202. The sheath member 212 is arranged to provide a reduced internal diameter of the tubing bore into which the plug member 210 can intrude thereby forming a sealed relationship between the shuttle member 206 and the sheath member 212. Optionally the plug member comprises sealing rings comprised of polymeric material or any other suitable material to ensure complete fluid sealing between the plug member 210 and the sheath member 212. Optionally the sheath member comprises sealing rings composed of polymeric material or any other suitable material to ensure complete fluid sealing between the plug member and the sheath member. Optionally the shuttle member 206 and/or the sheath member 212 are composed of a rigid material. Optionally this material is steel or some other suitable metal, alloy or composite. Optionally this material is any other suitable material.

In the first mode of operation of the tubing drain valve 200, the first lateral ports 204 and the further lateral ports 208 are at least partially arranged in an aligned relationship, which is determined by the relative position of the shuttle member 206 to the housing 202. A sleeve member 214 is located between the shuttle member and the housing 202. The sleeve member 214 is movable as an axially slidable member within the housing 202. Optionally the sleeve member 214 is composed of a rigid material. Optionally this material is steel or some other suitable metal, alloy or composite. Optionally this material is any other suitable material. In the first mode of operation of the tubing drain valve 125, the sleeve member 214 is disposed to ensure that the first lateral ports 204 are at least partly open to the annulus 122 by being located at a maximum axial displacement towards the first fluid communication region 130.

The housing comprises a seat 216 on its internal surface proximate to the first fluid communication region. The seat provides an abutment surface on which a downhole-facing surface of the sheath member 212 abuts in the first mode of operation. The seat 216 comprises at least one biasing element 218 configured to bias the sheath member 212 towards the first fluid communication region 130 such that the sheath member 212 abuts and remains abutted against the seat 216. The tubing drain valve 125 illustrated comprises a biasing element 218 that is a magnet. Optionally the biasing element is at least one magnet. Optionally the magnet is an array of magnets. Optionally the magnet or magnet array is configured to focus the magnetic field towards the abutting surface of the sheath member 212. Optionally the biasing element 218 is at least partially surrounded by cladding 220 for the purpose of either protection or insulation. Optionally this cladding is formed of a polymeric material. Optionally the cladding is formed of polyether ether ketone (PEEK). Optionally this cladding is a nylon. Optionally this cladding is metallic. Optionally this cladding is formed of any other suitable material. As illustrated in FIG. 2, the sheath member 212 may comprise an internal portion extending into the tubing bore beneath the seat 216 towards the first fluid communication region 130 which may aid in sealing.

The biasing element 218 provides a predetermined biasing force on the sheath member 212 thereby biasing the sheath member 212 towards the first fluid communication region 130 and ensuring its abutment against the seat 216. It will be understood that the biasing force determines a threshold cracking force that must be applied directionally towards the further fluid communication region in order to separate the sheath member 212 from the seat 216. The biasing element 218 is deliberately chosen in manufacturing to provide a particular cracking force. This cracking force can be provided by fluid pressure at the first fluid communication region 130 incident on the plug member 210. In this way the cracking force, and therefore the choice of biasing element 218, determines a threshold pressure that must be exceeded by a fluid at the first fluid communication region 130. Optionally this threshold pressure is between 100 psi and 500 psi. Optionally this threshold pressure is around 200 psi.

It will be understood that the sheath member 212 can also include a biasing element which optionally is a magnet or a magnet array to provide further attraction between the sheath member 212 and the seat 216. It will also be understood that the biasing element 218 can be incorporated into the sheath member 212 instead of the seat 216.

The tubing drain valve 125 additionally comprises at least one further biasing element 222, 224 which act to bias the shuttle member 206 towards the first fluid communication region 130. The tubing drain valve 125 illustrated comprises two further biasing elements 222, 224. The further biasing elements 222, 224 are springs which partially surround the shuttle member 206 at two positions within the housing 202. Optionally these springs can abut against a number of flared out portions 230, 232 of the shuttle member 206 thereby resisting motion of the shuttle member 206 towards the further fluid communication region 135. One such flared out portion provides a locking ring 230. Optionally a further flared out portion of the shuttle member 234 can abut against a further biasing element. Optionally the sleeve member abuts against a further biasing element 222.

The locking ring 230 is a flared-out ring portion of the shuttle member 206 and comprises a recess 236 around its circumference. The sheath member 212 comprises at least one sheath collet 240 and the sleeve member comprises at least one sleeve collet 242. As can be seen in FIG. 2B, in the first mode of operation of the tubing drain valve 125 the sheath collet 240 and the sleeve collet 242 intrude into the locking ring recess 236. In the first mode of operation of the tubing drain valve 125, the relative position of the shuttle member 206 and the housing 202 does not allow for the sheath collet 240 and the sleeve collet 242 to move out of the locking ring recess 236. Therefore, the shuttle member 206, the sheath member 212 and the sleeve member 214 are prohibited from moving independent of each other.

The first mode of operation of the tubing drain valve 125 disconnects the first fluid communication region 130 from the further fluid communication region 135 via the sealed relationship between the plug member 210 and the sheath member 212 whilst also determining a particular threshold pressure of fluid at the first fluid communication region 135 to permit connection of the first and further fluid communication regions thereby preventing unwanted connection of the first and further fluid communication regions until such a desired threshold pressure is achieved. The first mode of operation of the tubing drain valve 125 also provides axial alignment of the first lateral ports 204 and the further lateral ports 208 thereby allowing fluid communication between the annulus 122 and the tubing bore above the plug member 210 (including the further fluid communication region 135). The portion of the tubing bore below the plug member remains in fluid communication with the annulus 122 via the inlet port 140. The inability of the shuttle member 206, the sheath member 212 and the sleeve member 214 to move independently of each other ensures the at least partial alignment of the first lateral ports 204 and the further lateral ports 208, ensures that the first lateral ports 204 remains at least partially open to the annulus 122, and ensures that the first fluid communication region 130 and the further fluid communication region 135 are disconnected via the sealed relationship between the sheath member 212 and the plug member 210.

The first mode of operation of the tubing drain valve 125 corresponds to a situation in which the ESP 150 is switched off and no lift is thereby artificially introduced into a particular tubing arrangement 110 in a wellbore system 100. If the ESP 150 is switched off due to certain requirement of the wellbore system, the first lateral port 204 and the further lateral port 208 remain open to the annulus 122 thereby allowing fluid to ingress into and out of the tubing bore via the first and further lateral ports. The first and further fluid communication regions remain disconnected as to limit forced fluid flow through the ESP 150.

Figure 3A:
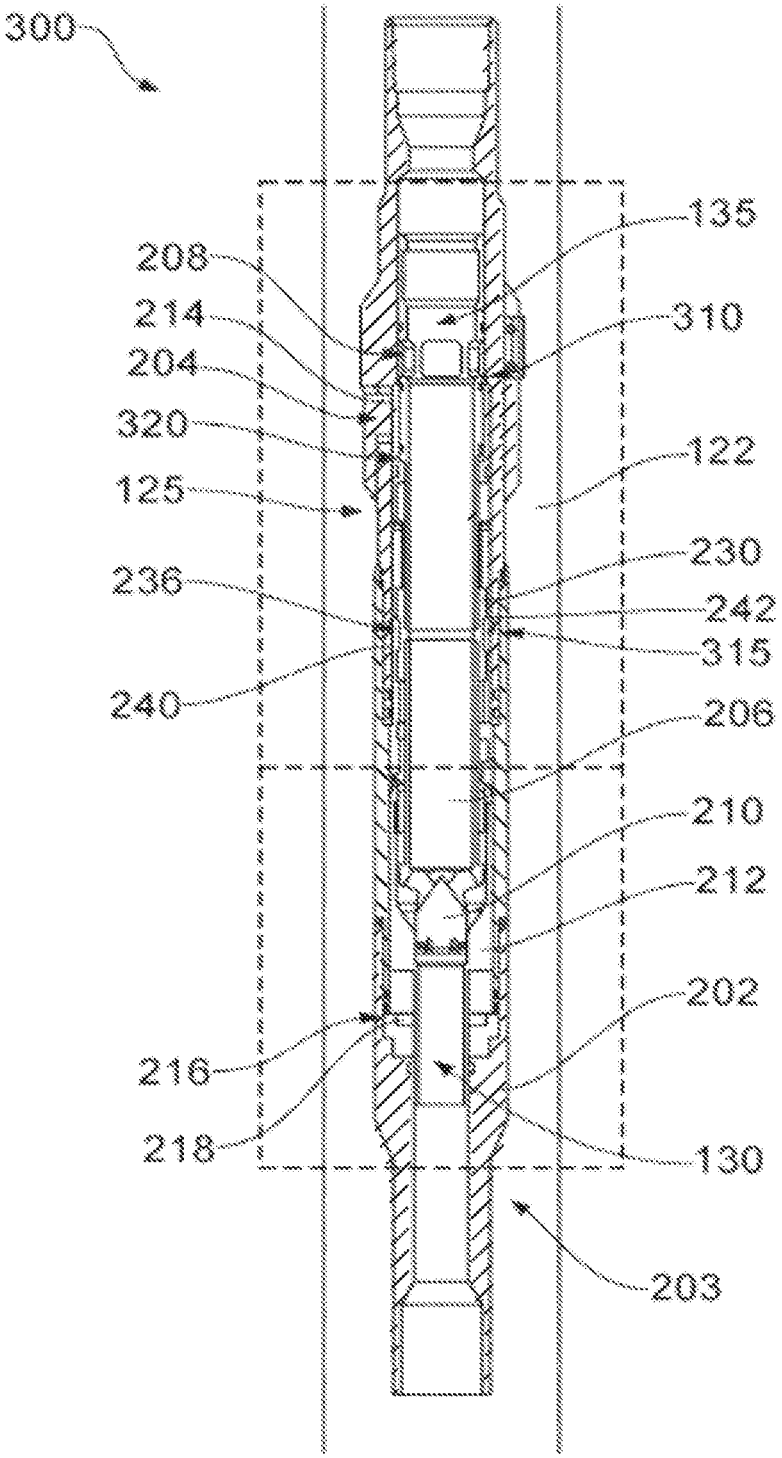
FIG. 3A illustrates a tubing drain valve in an intermediate mode of operation in which a first and further fluid communication region are disconnected.
Figure 3B:
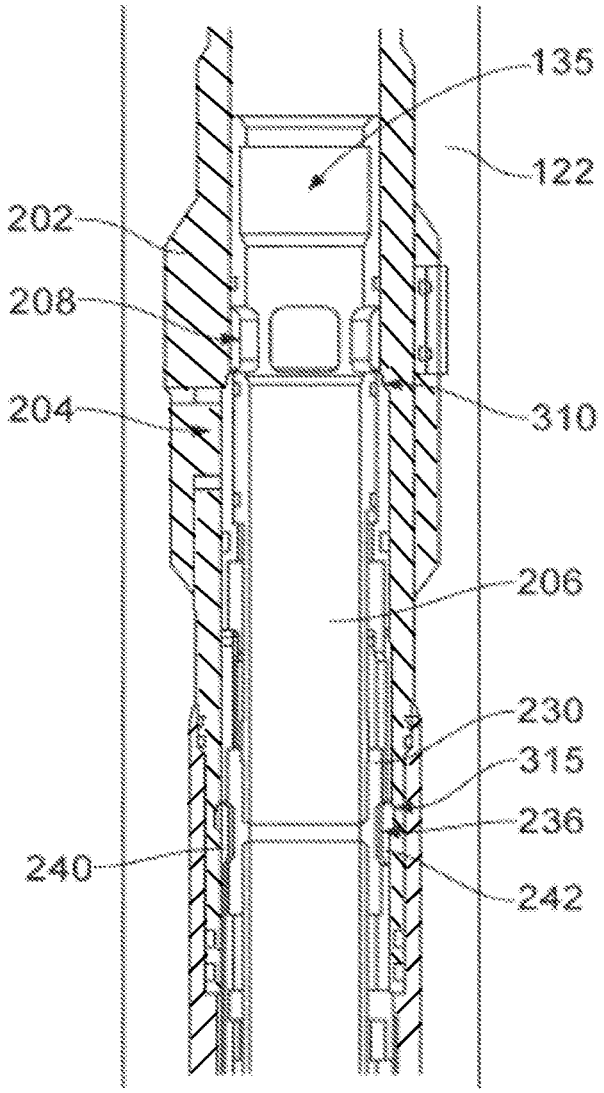
FIG. 3B illustrates an enlargement of the section of FIG. 3A enclosed by the upper dashed-line box.
Figure 3C:
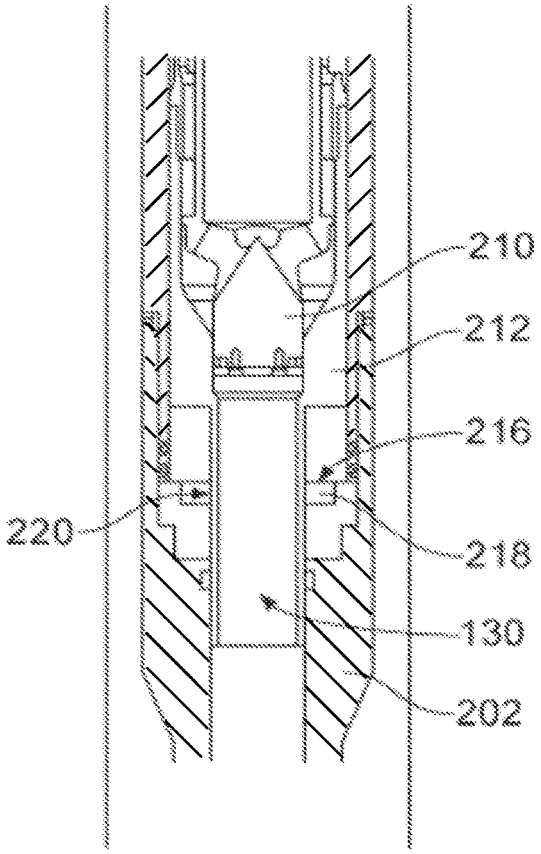
FIG. 3C illustrates an enlargement of the section of FIG. 3A enclosed by the lower dashed-line box.

FIG. 3A illustrates a cross section of a tubing drain valve 125 in an intermediate mode of operation 300. FIGS. 3B and 3C illustrate enlarged versions of the section of FIG. 3A contained within the upper dashed-line box and the lower dashed-line box respectively. The intermediate mode of operation corresponds to a situation wherein the tubing drain valve was recently in the first mode of operation (FIGS. 2A, 2B and 2C) and the ESP 150 has recently been switched on. The pressure of fluid at the first fluid communication region 130 has thereby recently exceeded the threshold pressure. The pressure of fluid acts on the base of the plug member 210 and in a direction towards the further fluid communication region 135. The sheath member 212 and the seat 216 are thereby separated. The sheath member 212 and the shuttle member 206 are moved towards the further fluid communication region 135 relative their positions with respect to the housing 202 in the first mode of operation 200 of the tubing drain valve 125 (FIGS. 2A, 2B and 2C) and remain in a sealing relationship. This is due to the sheath collet 240 being unable to escape from the locking ring recess 236 thereby prohibiting independent movement of the shuttle member 206 with respect of the sheath member 212. The separation between the sheath member 212 and the seat 216 is thus achieved by axial sliding of the sheath member together with the shuttle member towards the further fluid communication region 135 responsive to the fluid pressure.

The axial sliding of the shuttle member 206 relative to the housing 202 results in an axial non-alignment of the first lateral ports 204 and the further lateral ports 208 thereby closing the annulus 122 to the section of tubing bore above the plug member 210 (including the further fluid communication region 135). This results in a situation wherein the first and further fluid communication regions are disconnected via the sealing relationship between the plug member 210 and the sheath member 212 whilst the annulus 122 is simultaneously disconnected from the section of tubing bore above the plug member 210. Therefore, fluid cannot ingress into/out of the section of tubing bore above the plug member 210 from/to the first fluid communication region 135 and simultaneously through the first and further lateral ports which, in the instance of ESP 150 shutdown for example, may damage or block the ESP 150.

The axial movement of the shuttle member 206 towards the further fluid communication region 135 also results in equivalent movement of the sleeve member 214 due to the sleeve collet 242 being imprisoned in the locking ring 230. In the intermediate mode of operation of the tubing drain valve 125 the sleeve member 214 is disposed to close the first lateral ports 204 to the annulus 122 to further ensure that the annulus is disconnected from the section of tubing bore above the plug member 210. The sleeve member 214 moves with the shuttle member 206 until it abuts against an upper sleeve catch element 310 on the housing 202. This position of the shuttle member 206 and the sleeve member 214 relative to the housing 202 allows the sleeve collet 242 to escape the locking ring recess 236 via a first collet recess 315 in the inner surface of the housing 202. The shuttle member 206 comprises a lower sleeve catch element 320 which abuts against the sleeve member 214 when the shuttle member moves towards the first fluid communication region 130, and therefore towards the first mode of operation 200 of the tubing drain valve 125, thereby opening the first lateral port 204.

The intermediate mode of operation 300 of the tubing drain valve 125 may correspond to an instance in which the ESP 150 is switched off and the tubing drain valve, previously in a further mode of operation 400 of the tubing drain valve 125 (FIGS. 4A, 4B, 4C), is returning to the first mode of operation 200 of the tubing drain valve 125 (FIGS. 2A, 2B, 2C) under the influence of the biasing element 218 and/or the further biasing elements 222, 224. Fluid in the tubing arrangement 110 is therefore prevented from falling through the ESP 150.

Figure 4A:
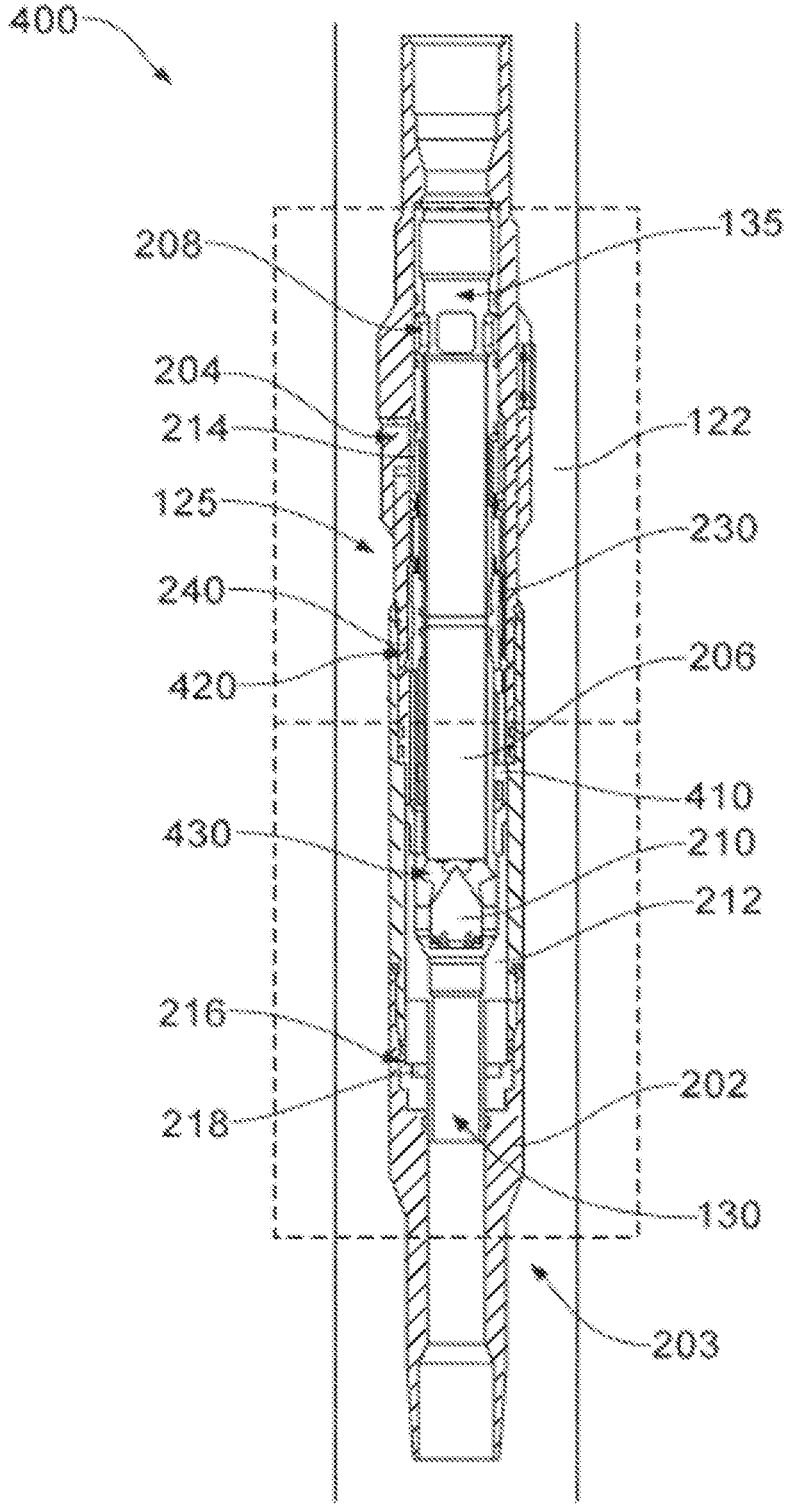
FIG. 4A illustrates a tubing drain valve in a further mode of operation in which a first and further fluid communication region are connected.
Figure 4B:
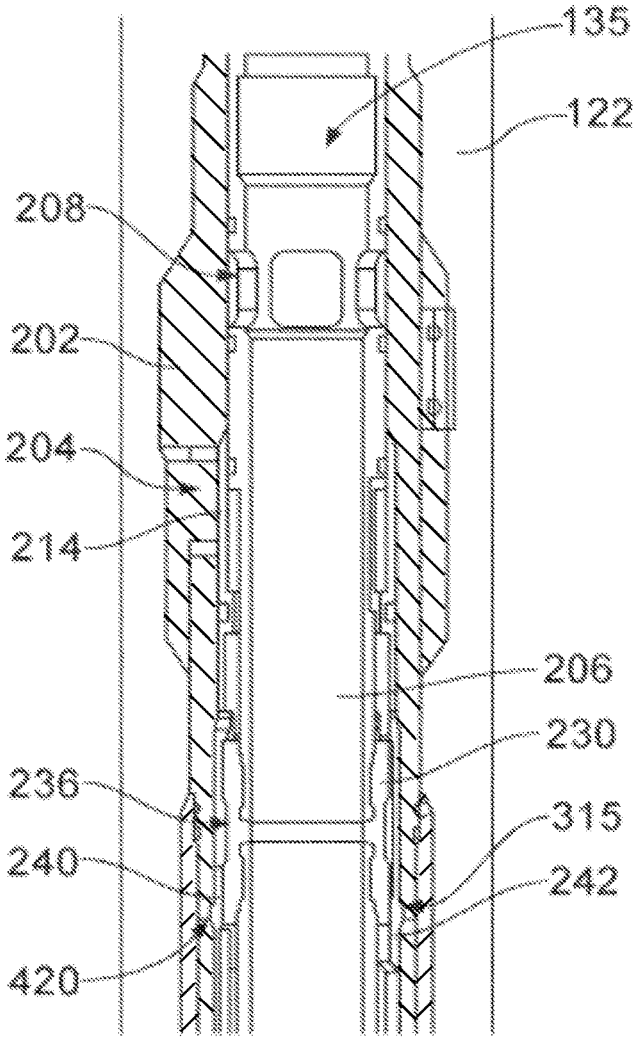
FIG. 4B illustrates an enlargement of the section of FIG. 4A enclosed by the upper dashed-line box.
Figure 4C:
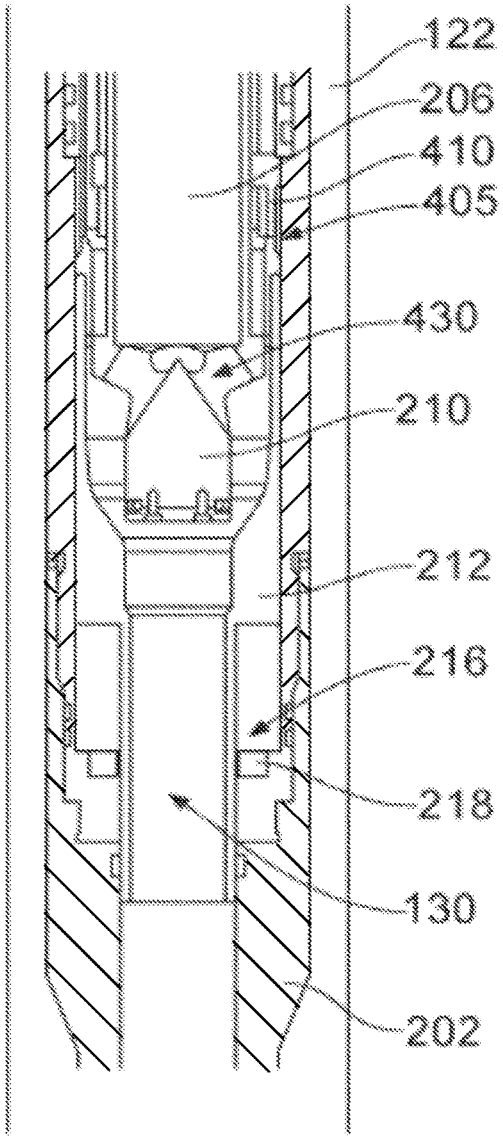
FIG. 4C illustrates an enlargement of the section of FIG. 4A enclosed by the lower dashed-line box.

FIG. 4A illustrates a cross section of a tubing drain valve 125 in a further mode of operation 400. FIGS. 4B and 4C illustrate enlarged versions of the section of FIG. 4A contained within the upper dashed-line box and the lower dashed-line box respectively. In the further mode of operation 400 of the tubing drain valve 125 the first fluid communication region 130 is connected to the further fluid communication region 135. This relates to a situation wherein the ESP 150 is switched on and the fluid pressure exceeds the threshold pressure thereby separating the sheath member 212 from the seat 216. The sheath member 212 is located further towards the further fluid communication region 135 relative to its position with respect to the housing 202 in the intermediate mode of operation 300 and the first mode of operation 200 of the tubing drain valve 125 (by axially sliding together with the shuttle member 206) and is at a maximum distance from the seat 216. This distance or catch point 405 is determined by a catch element 410 located on the internal surface of the housing 202 which abuts against an upper surface of the sheath element 212. The catch element 410 prevents the sheath member 212 from further axially sliding towards the further fluid communication region 135, together with the shuttle member 206, relative to the housing 202 responsive to the fluid pressure. Optionally this catch element 410 may also provide an abutment surface on which the locking ring of the shuttle member may abut in the first mode of operation 200 of the tubing drain valve 125 (FIGS. 2A, 2B, 2C) which defines a maximum displacement of the shuttle member towards the first fluid communication region 130. Locating the sheath member 212 at its maximum displacement towards the further fluid communication region 130, such that the sheath member 212 abuts against the catch element 410, allows the sheath collet 240 to escape the locking ring 230 into a further collet recess 420 in the inner surface of the housing 202. The shuttle member 206 may then axially move independently of the sheath member 212 (and the sleeve member 214).

Upon abutment of the sheath member 212 with the catch element 410 and release of the sheath collet 240 from the locking ring 230, fluid pressure acting on the plug member 210 results in further axial sliding of the shuttle member 206 towards the further fluid communication region 235 relative to the sheath member 212 and the housing 202. The further biasing elements 222, 224 bias the shuttle member 206 towards the sheath member 212 and the first fluid communication region 130 however, the fluid pressure in the further mode of operation 400 of the tubing drain valve 125 is sufficient to further axially slide the shuttle member 206 towards the further fluid communication region 135 and away from the sheath member 212. It will be understood that the two further biasing elements 222, 224 illustrated in FIGS. 2A-2C are present in the intermediate mode of operation 300 and the further mode of operation 400 of the tubing drain valve 125 and are not shown in FIGS. 3A-4C for illustrative clarity only. The two further biasing elements 222, 224 are springs.

This further sliding of the shuttle member locates the shuttle member 206 (and therefore the plug member 210) in a non-sealing relationship with the sheath member 212 wherein the plug member 210 and the sheath member 212 are separated. The shuttle member 206 comprises at least one channel proximate to, or within, the plug member 210 through which fluid from the first communication region 130 can flow thereby connecting the first fluid communication region 130 and the further fluid communication region 135. It will be understood that the channel 430 will be closed to the first fluid communication region 130 when the plug member 210 and the sheath member 212 are disposed in a sealed relationship. It will also be understood that further axial movement of the shuttle member 206 towards the further fluid communication region 135 relative to its position with respect to the housing in the intermediate mode of operation 300 of the tubing drain valve 125 (FIG. 3A, 3B, 3C) disposes the first lateral ports 204 and the further lateral ports 208 in a non-aligned relationship. The sleeve member 214 remains disposed to close the first lateral port 204 to the annulus.

Upon switching the ESP off, it will be understood that the further biasing elements 222, 224 and/or the biasing element 218 will bias the sheath member to axially move towards the first fluid communication region to abut against the seat due to the reduced fluid pressure in the absence of artificial lift. Such a reduction in fluid pressure due to switching off the ESP will also result in the further biasing elements 222, 224 biasing the shuttle member towards the first fluid communication region such that the shuttle member 206 returns to be in a sealing relationship with the sheath member 212 via the plug member 210. Depending on the pressure drop and properties of the first and further biasing elements 222, 224, the tubing drain valve 125 may, for a short time period or instantaneously, return to the intermediate mode of operation 300 before returning to the first mode of operation 200 wherein the first and further fluid communication regions are disconnected. It will be understood that the sleeve collet 242 and the sheath collet 240 will return to in imprisoned state within the locking ring 230 in the absence of lift thereby ensuring that the sleeve member 214, the sheath member 212 and the shuttle member cannot axially move independently once interlocked.

Figure 5B:
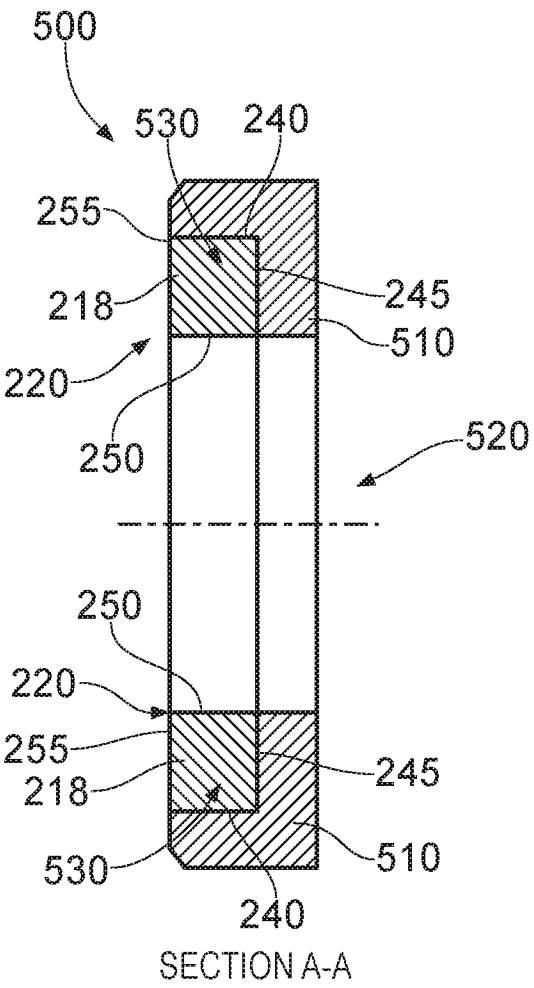
FIG. 5B illustrates a cross section of a biasing assembly.
Figure 5A:
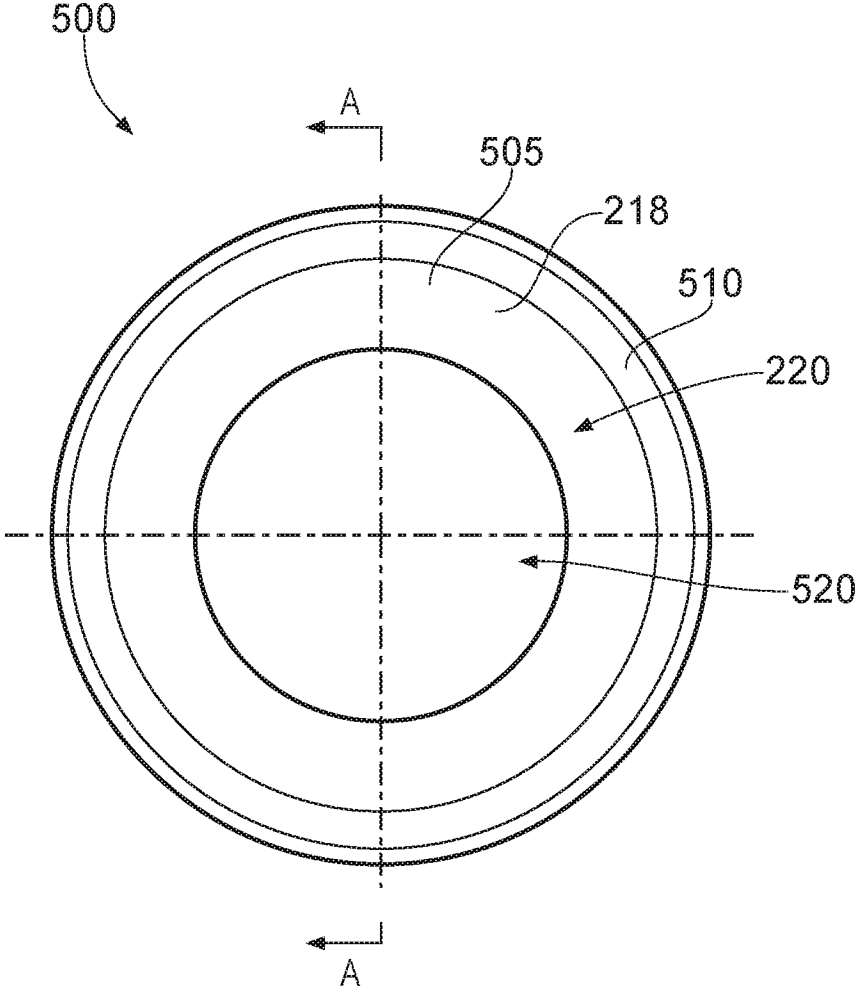
FIG. 5A illustrates a biasing assembly viewed along the major axis of the tubing arrangement.

FIG. 5A illustrates a biasing assembly 500 that may be integrated into the housing 202 of the tubing drain valve 125. The biasing assembly 500 is viewed along an axis that corresponds to the major axis of the tubing arrangement when installed. In particular, the biasing assembly 500 is integrated into the seat 216. It will be understood that the biasing assembly 500 can optionally be included at a different position in the housing 202. It will also be understood that biasing assembly 500 can be included in the sheath member 212. The biasing assembly 500 comprises the biasing element 218. The biasing element optionally comprises a magnet 505. Optionally the magnet 505 is a ring-shaped magnet. Optionally the biasing element 218 can comprise segmented magnets arranged in a ring. Optionally the biasing element 218 can comprise multiple magnets arranged in any suitable configuration. Optionally the biasing element 218 can comprise any other suitable biasing device. Optionally, when installed in a tubing drain valve 125, the magnet 505 provides a biasing force of between 1000 N and 5000 N on a sheath member 212. Optionally, when installed in a tubing drain valve 125, the magnet 505 provides a biasing force of around 3300 N on a sheath member 212. Optionally the biasing force decays so that at distances of less than a metre from the magnet the magnitude of the biasing force is significantly reduced. Optionally the biasing force decays so that at distances of around a few cm from the magnet the magnitude of biasing force is significantly reduced.

The biasing element 218 sits inside a ring-shaped pot 510. The pot 510 comprises a cutaway region in which the biasing element 218 is positioned such that the biasing arrangement 500 is ring-like. Optionally the biasing element 218 is secured to the pot 510. Optionally the biasing element 218 is secured to the pot by an adhesive. Optionally this adhesive is/comprises epoxy resin. Optionally this adhesive is Loctite 648. Optionally any other suitable adhesive. Optionally the biasing element 218 is secured to provide a biasing element 218 to pot 510 pull force of up to 100 $N/mm^2$. Optionally the biasing element 218 to pot 510 pull force is around 25 $N/mm^2$. Optionally the biasing element 218 to pot 510 pull force is provided over between 1000 $mm^2$ and 10000 $mm^2$. Optionally the biasing element 218 to pot 510 pull force is provided over around 5000 $mm^2$.

The biasing element 218 and the pot 510 are arranged to surround an internal space 520 that provides a portion of the tubing bore through which fluid can flow. Optionally one or more other materials can be arranged between the biasing element 218 and the internal space 520. Optionally one or more other materials can be arranged between the pot 510 and the internal space 520. Optionally these materials are polymeric. Optionally the biasing element 218 is at least partly covered in cladding 220. Optionally this cladding is formed of a polymeric material. Optionally the cladding is formed of polyether ether ketone (PEEK). Optionally this cladding is a nylon. Optionally this cladding is metallic. Optionally this cladding is formed of any other suitable material. Optionally the cladding 220 is between 0 mm and 10 mm thick. Optionally the cladding 220 is between 0 mm and 1 mm thick. Optionally the cladding 220 is between 0.1 mm and 0.15 mm thick. Optionally the cladding covers the exposed surfaces of the biasing element 218. Optionally the surface or surfaces of the biasing element 218 in contact with (and optionally adhered to) the pot 510 do not include cladding.

FIG. 5B illustrates a cross section of a biasing assembly 500 along the A-A axis illustrated in FIG. 5A. The arrangement of the biasing element 218 which sits in a cutaway region 530 of the pot can be seen more clearly. The ring-shaped arrangement of the biasing assembly 500 at least partially enclosing the internal space 520 is shown. Abutment surfaces 240, 245 of the biasing element 218 which optionally may be adhered to the pot are indicated. Exposed surfaces 250, 255, which optionally may be covered in cladding 220 are indicated. It will be understood that the biasing element 218 in FIGS. 2A, 2C, 3A, 3C, 4A, 4C, 5A and 5B is a magnet.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. An apparatus for selectively connecting a first fluid communication region to a further fluid communication region at a downhole location, the apparatus comprising:

an elongate housing, locatable in a wellbore, comprising a first end portion associated with a first fluid communication region, wherein the housing further comprises a first lateral port proximate the further fluid communication region, wherein the first lateral port extends through the housing to an annulus surrounding the apparatus in the wellbore;

a sheath member axially slidable within the housing and biased towards the first end portion via a first biasing element; and an elongate shuttle member axially slidable within the housing and slidably locatable in a sealed relationship or non-sealed relationship with the sheath member, wherein the shuttle member comprises a further lateral port that can be selectively aligned with the first lateral port to place the further fluid communication region in fluid communication with the annulus; wherein the first biasing element provides a predetermined biasing force that determines a threshold pressure which must be exceeded by a fluid pressure at the first fluid communication region to permit axial movement of the sheath member away from the first fluid communication region and towards the further fluid communication region.

2. The apparatus as claimed in claim 1, wherein:

in a first mode of operation, the sheath member is biased towards the first end portion and the shuttle member is disposed in a first position providing the sealed relationship with the sheath member and the first lateral port and the further lateral port are aligned;

in an intermediate mode of operation, the sheath member is axially displaced towards the further fluid communication region relative to said position of the first mode of operation but remains disposed in the sealed relationship with the shuttle member and the first lateral port and the further lateral port are not aligned; and in a further mode of operation, the shuttle member is further axially displaced towards the further fluid communication region and is disposed in the non-sealed relationship with the sheath member and the first lateral port and the further lateral port are not aligned.

3. The apparatus as claimed in claim 2, further comprising:

a sleeve member axially slidable within the housing and disposed between the housing and the shuttle member, wherein the sleeve member is configured to at least partially leave open the first lateral port in the first mode of operation, and wherein the sleeve member is configured to close the first lateral port in the intermediate and further mode of operation.

4. The apparatus as claimed in claim 1 further comprising:

the first biasing element comprises at least one magnetic element and optionally the housing comprises a seat in which the magnetic element is disposed; wherein the seat provides an abutment surface against which the sheath member abuts in the first mode of operation to thereby set one extent of axial movement of the sheath member.

5. The apparatus as claimed in claim 4, wherein the first biasing element is at least partially covered by protective cladding.

6. The apparatus as claimed in claim 1, further comprising an electric submersible pump (ESP) locatable at or proximate to the first fluid communication region, and wherein:

said fluid pressure is determined by operation of the electric submersible pump (ESP).

7. The apparatus as claimed in claim 1, further comprising:

a sleeve member; and a second biasing element to bias the sheath member, the shuttle member and optionally the sleeve member towards the first fluid communication region.

8. The apparatus as claimed in claim 1, further comprising:

at least one catch element on an inner surface of the housing disposed to prevent the sheath member from axially moving towards the further fluid communication region beyond a predetermined distance.

9. The apparatus as claimed in claim 1, wherein the apparatus further comprises:

a multi-pump system that includes a plurality of electric submersible pumping systems; wherein the housing, sheath member and shuttle member are installed in the multi-pump system within the wellbore.

10. A method of selectively connecting a first fluid communication region to a further fluid communication region at a downhole location, comprising:

providing an elongate housing in a wellbore with a sheath member axially slidable within the housing, wherein the housing comprises a first lateral port that extends to an anulus surrounding the housing;

providing an elongate shuttle member axially slidable within the housing, the shuttle member comprising a further lateral port that is aligned with the first lateral port when the shuttle member is positioned toward the first fluid communication region and wherein the shuttle member is in a sealed relationship with the sheath member when the shuttle member is positioned toward the first fluid communication region;

providing a predetermined biasing force on the sheath member via at least one biasing element thereby urging the sheath member towards the first fluid communication region, the biasing force determining a threshold pressure which must be exceeded by a fluid pressure at the first fluid communication region to permit axial movement of the sheath member away from the first fluid communication region and towards the further fluid communication region;

axially moving the shuttle member and the sheath member together away from the first fluid communication region and towards the further fluid communication region when the fluid pressure exceeds the threshold pressure to remove the alignment between the first lateral port and the further lateral port; and axially moving the shuttle member independently of the sheath member away from the first fluid communication region and towards the further fluid communication region when the sheath member has axially moved a predetermined distance away from the first fluid communication region and towards a further fluid communication region.

11. The method as claimed in claim 10, further comprising:

providing at least one catch element that determines the predetermined distance that the sheath member is axially movable away from the first fluid communication region and towards the further fluid communication region.

12. The method as claimed in claim 10, wherein the housing includes a sleeve member axially slidable within the housing and disposed between the housing and the shuttle member such that the sleeve member is configured to selectively close the first lateral port, the method further comprising:

axially moving the sleeve member away from the first fluid communication region and towards the further fluid communication region such that the sleeve member closes the first lateral port.

13. The method as claimed in claim 10, wherein the step of providing the predetermined biasing force on the sheath member via the at least one biasing element further comprises providing the predetermined biasing force with at least one magnetic element.

14. The method as claimed in claim 10, further comprising:

providing at least one further biasing element to bias the sheath member, the shuttle member and optionally a sleeve member towards the first fluid communication region, and wherein optionally the further biasing element is a spring.

15. The method as claimed in claim 10, wherein the step of axially moving the shuttle member and the sheath member together away from the first fluid communication region and towards the further fluid communication region when the fluid pressure exceeds the threshold pressure further comprises increasing the fluid pressure beyond the threshold pressure with an ESP at or proximate to the first fluid communication region.

16. A system for extracting fluids from a subterranean fluid deposit through a wellbore, the system comprising:

an electric submersible pumping system deployed in the wellbore;

a tubing arrangement in the wellbore; and a tubing drain valve connected between the electric submersible pumping system and the tubing arrangement, the tubing drain comprising:

an elongate housing having a first end closer to the electric submersible pumping system and a second end closer to the tubing arrangement, wherein the elongate housing comprises:

a first lateral port proximate the second end of the elongate housing, wherein the first lateral port extends through the elongate housing to an annular space surrounding the tubing drain valve in the wellbore; and a seat proximate the first end of the elongate housing;

a sheath configured for axial movement within the elongate housing, wherein the sheath is configured to abut the seat when the sheath is positioned near the first end of the elongate housing;

a sleeve member configured for axial movement within the elongate housing, wherein the sleeve covers the first lateral port when the sleeve is positioned toward the second end of the housing; and a shuttle member configured for axial movement within the elongate housing, wherein the shuttle member comprises:

a further lateral port configured for alignment with the first lateral port when the shuttle member is located toward the first end of the elongate housing;

a plug configured to seal the sheath when the shuttle is connected to the sheath; and wherein the shuttle member is configured for connection and disconnection from the sheath and sleeve member.

* * * * *